US011248511B2

(12) United States Patent
Hugh et al.

(10) Patent No.: US 11,248,511 B2
(45) Date of Patent: Feb. 15, 2022

(54) SINUOUS BALANCED TAILPIPE SYSTEM

(71) Applicant: Active Automotive Group Inc., Miami, FL (US)

(72) Inventors: David Hugh, Miami, FL (US); Karl Hugh, Miami, FL (US)

(73) Assignee: Active Automotive Group Inc., Miami, FL (US)

( * ) Notice: Subject to any disclaimer, the term of this patent is extended or adjusted under 35 U.S.C. 154(b) by 0 days.

(21) Appl. No.: 17/113,648

(22) Filed: Dec. 7, 2020

(65) Prior Publication Data

US 2021/0293173 A1 Sep. 23, 2021

Related U.S. Application Data

(60) Provisional application No. 62/991,631, filed on Mar. 19, 2020.

(51) Int. Cl.

| | |
|---|---|
| ***F01N 13/08*** | (2010.01) |
| ***F01N 1/02*** | (2006.01) |
| ***F01N 13/10*** | (2010.01) |

(52) U.S. Cl.

CPC ..... *F01N 13/082* (2013.01); *F01N 1/02* (2013.01); *F01N 13/107* (2013.01); *F01N 2470/16* (2013.01)

(58) Field of Classification Search

CPC ..... F01N 1/02; F01N 2470/18; F01N 2470/20

See application file for complete search history.

(56) References Cited

U.S. PATENT DOCUMENTS 3,198,284 A * 8/1965 Powers ..... F01N 1/02 181/266
3,543,878 A 12/1970 Hamilton
5,062,263 A * 11/1991 Carboni ..... F01N 13/1888 60/299
5,519,994 A * 5/1996 Hill ..... F01N 1/00 181/238

(Continued)

OTHER PUBLICATIONS

D660-0060—Dinan High Flow X-Pipe for BMW F80 M3 F82 M4; CarBahn Autoworks (copyright 2019); https://carbahnautoworks.com/product/d660-0060-dinan-high-flow-x-pipe-for-bmw-f80-m3-f82-m4/ (Date captured Oct. 16, 2020).

(Continued)

*Primary Examiner* — Anthony Ayala Delgado
(74) *Attorney, Agent, or Firm* — The Concept Law Group. P.A.; Robert C. Kain, Jr.

(57) ABSTRACT

A sinuous balanced mid-pipe exhaust system has a straight mid-pipe and a sinuous mid-pipe disposed intermediate manifold and muffler. The manifold has a differential bilateral manifold pipe length. The longer manifold pipe connected to the straight mid-pipe and the shorter manifold pipe connected to the sinuous mid-pipe. Sinuous mid-pipe has 2-3 sinusoidal curved segments such that a sinuous gas flow path therethrough substantially equals the straight pipe flow path length and the manifold differential pipe length. The method balances and equalizes gas flows by defining straight gas flow path, having a path length and defining a sinuous gas flow path with at least two sinusoidal segments which is equal to the path length and the differential path length.

9 Claims, 6 Drawing Sheets

(56) References Cited

U.S. PATENT DOCUMENTS

| | | | | |
|---|---|---|---|---|
| 6,622,482 | B2 * | 9/2003 | Knight | F01N 1/165 181/258 |
| 6,644,437 | B1 | 11/2003 | Hayman | |
| 6,912,843 | B2 * | 7/2005 | Hufendiek | F01N 1/02 60/282 |
| 8,402,756 | B2 * | 3/2013 | Luce | F01N 13/1805 60/313 |
| D887,930 | S | 6/2020 | Borla | |
| 2018/0023429 | A1 | 1/2018 | Borla | |

OTHER PUBLICATIONS

Tenneco Sound Engineering; Heinrich Gillet GmbH; 6 pages (Date captured on Oct. 1, 2020) www.gillet.com www.tenneco-automotive.com.

Extended European Search Report; Completed May 11, 2021.

* cited by examiner

SECTION A-A'
FIG.4A
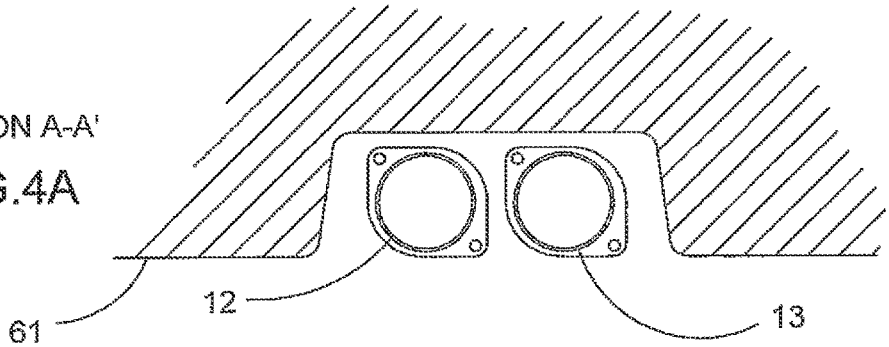
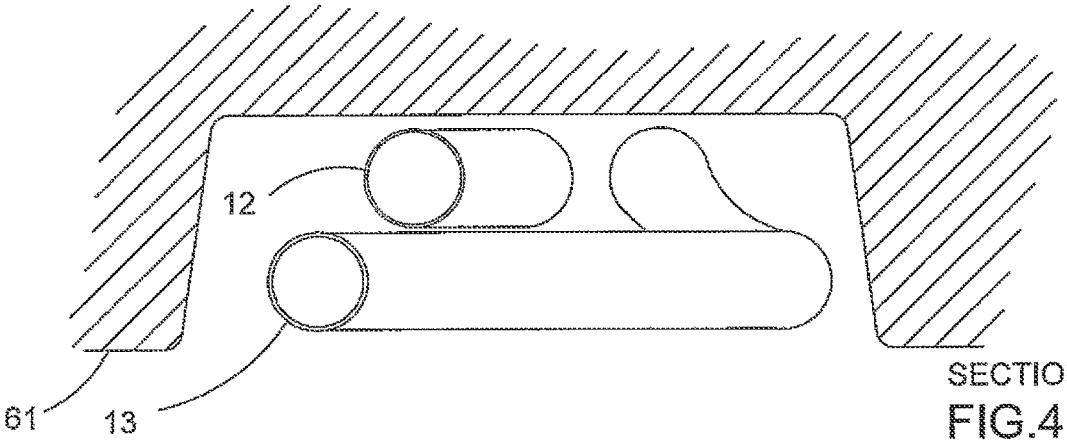
SECTION B-B'
FIG.4B
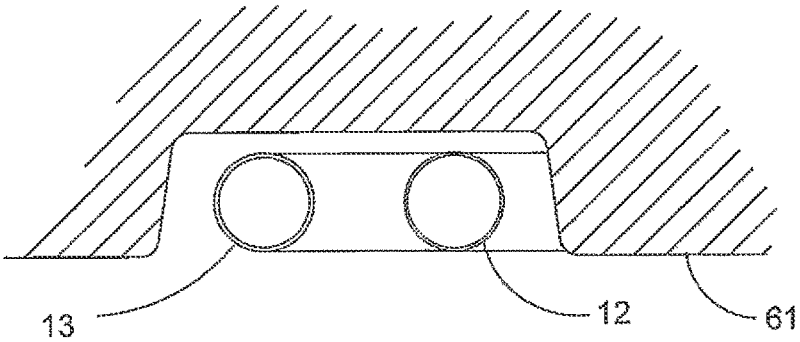
SECTION C-C'
FIG.4C

SINUOUS BALANCED TAILPIPE SYSTEM

This is a regular, non-provisional patent application based upon and claiming the benefit of provisional patent application Ser. No. 62/991,631, filed Mar. 19, 2020, the contents of which is incorporated herein by reference thereto.

FIELD OF THE INVENTION

The present relates to a sinuous balanced tailpipe system and a method to achieve the same. More particularly, the present invention relates to a midsection tailpipe system attachable between (a) twin exhaust manifold pipes, each manifold exhaust pipe having a different length, and (b) upstream from a rear mounted muffler system.

BACKGROUND OF THE INVENTION

Some automobiles have manifold exhaust pipes having different lengths. The stock-provided tailpipe system feeds exhaust gas from the manifold exhaust pipes (those pipes having a differential length of between 12 inches and 16 inches) to a rear mounted exhaust muffler system mounted beneath the rear end of the automobile. As a result of the differential length in the right side (passenger-side) tailpipe system, as compared to the left side (driver-side) tailpipe system (the differential length between these two manifold exhaust pipes being between 12 inches and 16 inches), the sonic output of exhaust gas from these particular automobiles is not pleasant. The differential length between the left and right tailpipe systems creates an unpleasant sonic or acoustic sound.

The genesis of the problem solved by the present invention involved a study of an inline six cylinder combustion engine. Oftentimes these engines have an evenly spaced exhaust pulse which results in a more smooth and full sounding noise (timbre) from the exhaust system during operation of the vehicle. However, a specific noise problem was encountered in connection with the twin turbo setup of the BMW S55/S58 engine, which, while producing additional power for the vehicle, creates a sound which sounds more like a two, independent inline three cylinder engine competing for noise than the throaty sound the BMW driver would expect.

The prior art BMW tailpipe system includes (a) left and right manifold exhaust pipes which have a differential length between 12 inches and 16 inches (these pipes terminate in a rear facing flange); (b) a straight midsection tailpipe (left and right midsection tailpipes) which run in a limited space, beneath the chassis of the automobile, and as a requirement, only fit in that limited space and are suspended beneath the chassis by a small number of hangers or straps (the left and right midsectional tailpipes do not alter or account for the 12-16 inch differential); and (c) a rear-mounted muffler system having a forward flange, joint or coupling attachable to the rear of the left and right midsection tailpipes.

It was discovered that the cause of the unpleasant sonic output of the automobile is primarily due to the two straight midsection stock tailpipes running and extending from the rear flange of the manifold exhaust pipes to the forward flange, joint or coupler for the rear mounted exhaust muffler system which do not compensate for the 12-16 inch exhaust manifold differential.

Prior art vehicle exhaust systems are known to have twists and turns (curves) in order to fit the exhaust system beneath the undercarriage of the vehicle but these system do not adjust a dual tailpipe sound issue. Some prior art systems use shallow curves and some major curves and those prior art exhaust systems were designed to fit in the manufacturer-supplied undercarriage space. See, for example, the Dinan High Flow X-Pipe for BMW F80 M3 F82 M4 made by CarBahn Autoworks, U.S. Pat. No. Des. 887,930; U.S. Pat. No. 3,543,878. Some prior art manufacturers also sound-tune vehicle exhaust pipes. See "Sound Engineering" by Tenneco which discusses a balanced exhaust sound system.

Another prior art system, U.S. Pat. No. 10,808,584 discloses a timbre scaled exhaust system for tuning an exhaust flow from an internal combustion engine and producing an exhaust note that has a desirable sound or timbre. This prior art system includes a plurality of tuning tubes disposed inside a tailpipe to attenuate any unwanted exhaust sounds and produce an overall desirable timbre without requiring the use of a traditional structure.

Therefore, a need exists to overcome the problems with the prior art as discussed above.

SUMMARY OF THE INVENTION

The invention provides a a sinuous balanced tailpipe system and a method that overcomes the herein aforementioned disadvantages of the heretofore-known devices and methods.

The aforementioned problem is solved by the present invention which takes into account this 12-16 inch differential and provides midsectional left and right tailpipes which account for and compensate for the differential lengths of the left and right manifold exhaust pipes, including, importantly, the placement of the new midsection left and right tailpipes within the form and shape of the tailpipe passage formed by the undercarriage and chassis of the automobile. The new left and right midsection tailpipes snugly fit in the tailpipe passage formed by the undercarriage and chassis of the automobile without altering that tailpipe passage.

One advantage of the present invention is to employ several sinusoidal curves in the new tailpipe system which elongate the foreshortened exhaust manifold pipe such that the entire tailpipe system for the automobile is substantially the same length.

Another of the several advantages of the present invention is to provide a balanced exhaust system for an internal combustion engine which has a manifold pipe differential that generates noxious sounds due the length of the manifold pipes on one side of the engine compared to the length of the manifold pipes on the other side of the engine. This bilateral manifold pipe differential creates noxious noises upon acceleration and sometimes deceleration of the vehicle.

Another advantage of the present invention is to create a longer exhaust gas flow path in a mid-pipe section of the tailpipe system by (a) having one mid-pipe with a substantially straight exhaust gas flow path (substantially straight including the presence of shallow curvaceous segments)(this straight pipe fluidly connected to the longer manifold output pipe) and (b) a second mid-pipe having at least two, and sometimes three sinusoidal curved segments which add an exhaust gas path generally equivalent to the bilateral manifold pipe differential.

A further advantage the present invention is to provide these two mid-pipes in a shape and configuration that is form-fitted into the small space beneath the undercarriage of the vehicle such that reconfiguration of the undercarriage space for the manufacturer-supplied mid-pipes need not be altered or reconstructed.

With the foregoing and other objects in view, there is provided, in accordance with the invention, and in combination with an internal combustion engine having first and second manifold exhaust pipes with a differential length therebetween, a sinuous balanced mid-pipe exhaust system disposed intermediate the manifold and the muffler having a first mid-pipe as a substantially straight mid-pipe coupled to one short-length manifold pipe and coupled downstream to the muffler (the straight mid-pipe having a predetermined fluid path length) and a second sinuous mid-pipe fluidly connected to a long-length manifold pipe (and downstream at the muffler) having two or more substantially sinusoidal curved segments such that a sinuous fluid path through the sinuous mid-pipe substantially equals the predetermined fluid path length and the differential manifold pipe length.

In accordance with another feature, an embodiment of the present invention includes sinusoidal curved segments having 360 degree sine curves.

In accordance with a further feature of the present invention, a method for balancing and equalizing exhaust gas flows is provided. The manifold system has bilateral manifold exhaust pipes with a differential manifold gas flow path length therebetween. Downstream, the exhaust is fed into a muffler. The method defines a substantially straight exhaust gas flow path having a predetermined exhaust gas flow path length from the manifold to the muffler. The method also defines a sinuous gas flow path with at least two sinusoidal segments from the manifold to the muffler, the sinuous gas flow path being substantially equal to the predetermined flow path length and the differential path length.

A summary of one of the several embodiments of a sinuous balanced mid-pipe exhaust system follows. The sinuous balanced mid-pipe is disposed intermediate a manifold and a downstream muffler. The manifold has first and second manifold output ports and a differential manifold pipe length between bilateral manifold pipes. The muffler has first and second muffler input ports. The inventive system includes a substantially straight mid-pipe adapted to be mounted at a corresponding upstream end to the first manifold output port and at a corresponding downstream end to one muffler input port. The straight mid-pipe has a predetermined exhaust gas flow path length from the manifold to the muffler. The inventive system also has a sinuous mid-pipe adapted to be mounted at a respective upstream end to another manifold output port and at a respective downstream end to the muffler. The sinuous mid-pipe has at least two sinusoidal curved segments such that a sinuous gas flow path therethrough substantially equals the predetermined flow path length and the differential pipe length.

A further enhancement includes a crossover gas mixer fluidly connected to the sinuous mid-pipe and the straight mid-pipe at adjacently upstream the muffler input ports. The crossover gas mixer has a gas flow passage substantially equivalent to gas flow passages in the sinuous and straight mid-pipes. An additional enhancement includes the straight mid-pipe having a curvaceous segment and the sinuous gas flow path, defined by the sinuous mid-pipe, includes a compensating curvaceous segment such that the sinuous gas flow path substantially equals the predetermined flow path length and the differential manifold pipe length.

A summary of another embodiment of the inventive method involves balancing and equalizing exhaust gas flows between a manifold system and a muffler system. The manifold has bilateral manifold exhaust pipes with a differential manifold gas flow path length therebetween. The method includes defining a substantially straight exhaust gas flow path having a predetermined exhaust gas flow path length from the manifold to the muffler, and, defining a sinuous gas flow path with at least two sinusoidal segments from the manifold to the muffler, the sinuous gas flow path being substantially equal to the predetermined flow path length and the differential manifold path length.

An enhancement of the method includes shallow curvaceous segment in both the straight exhaust gas flow path and the sinuous gas flow path.

Another inventive method for balancing and equalizing exhaust gas flows between a manifold system and a muffler system (the manifold having bilateral manifold exhaust pipes with a differential manifold gas flow path length) includes defining a substantially straight exhaust gas flow path, with a shallow curvaceous segment therein, having a predetermined exhaust gas flow path length from the manifold to the muffler and further includes defining a sinuous gas flow path, with at least two sinusoidal segments and with a further shallow curvaceous segment therein, from the manifold to the muffler. The sinuous gas flow path being substantially equal to the predetermined flow path length and the differential path length. The straight exhaust gas flow path and the sinuous gas flow path being independent gas flows until being mixed together adjacently upstream the muffler.

It should be noted that the present invention can be deployed in combination with an internal combustion engine. The manifold exhaust pipes have a differential length therebetween wherein the first manifold pipe is substantially longer than the second manifold pipe. The inventive sinuous balanced mid-pipe exhaust system is disposed intermediate manifold output ports and the muffler input ports. The inventive sinuous balanced mid-pipe exhaust system includes a first mid-pipe, as a substantially straight mid-pipe, having a corresponding first upstream port adapted to be fluidly connected to the first manifold output port and having a corresponding first downstream port adapted to be fluidly connected to the muffler input port. This straight mid-pipe having a predetermined fluid path length. The system also includes a second mid-pipe, as a sinuous mid-pipe, having a corresponding second upstream port adapted to be fluidly connected to the second manifold output port and fluidly connected downstream to another muffler input port. The sinuous mid-pipe has two or more substantially sinusoidal curved segments such that a sinuous fluid path through the sinuous mid-pipe substantially equals the predetermined fluid path length and the differential length.

Additional, optionally applied enhancements are (a) sinusoidal curves forming a 360 degree sine curve; (b) a predefined undercarriage passageway with upstream, adjacent first and second manifold output ports and downstream adjacent first and second muffler input ports wherein the straight mid-pipe and the sinuous mid-pipe are form-fitted and adapted to be disposed in the undercarriage passageway; (c) the straight mid-pipe having an angular cross-over segment and the sinuous mid-pipe having either a curvaceous underpass or an overpass segment adjacent the angular cross-over due to a lateral passage in the predefined undercarriage passageway; (d) an exhaust gas crossover at downstream regions of the straight mid-pipe and the sinuous mid-pipe fluidly mixing exhaust gas adjacently upstream the first and second muffler input ports; and (e) the straight and the sinuous mid-pipes and the gas crossover have substantially similar cross-sectional dimensions.

Although the invention is illustrated and described herein as embodied in a sinuous balanced mid-pipe exhaust system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "providing" is defined herein in its broadest sense, e.g., bringing/coming into physical existence, making available, and/or supplying to someone or something, in whole or in multiple parts at once or over a period of time.

In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the length of the vehicle and "lateral" being generally perpendicular to the longitudinal aspect.

As used herein, the term "timbre" or "timbre scaled" refers to an exhaust system tuning exhaust flow from an internal combustion engine and producing an exhaust note that has a desirable sound or timbre. As used herein, the term "sinusoidal" means "having the form of a sine curve" and is substantially a 360 degree curve. Hence, a nominal system is the sinuous mid-pipe having two sinusoidal curves, each curve having a nearly 360 degree pipe twist. The term "form-fitted" means that the vehicle has a predefined vehicular undercarriage passageway within which the manufacturer-supplied mid-pipes are disposed and the straight mid-pipe and the sinuous mid-pipe are shaped to fit within and be form-fitted to and are adapted to be disposed in the manufacturer-supplied, predefined undercarriage passageway. The term "bilateral" means having or relating to two sides (for example, bilateral hearing is essential for sound location).

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIGS. 3 and 4A, 4B and 4C diagrammatically illustrate the mid-pipes (FIG. 3) and schematically illustrates the cross-sectional shape of the tailpipe passage defined by the undercarriage of the vehicle.

DETAILED DESCRIPTION

Figure 1A:
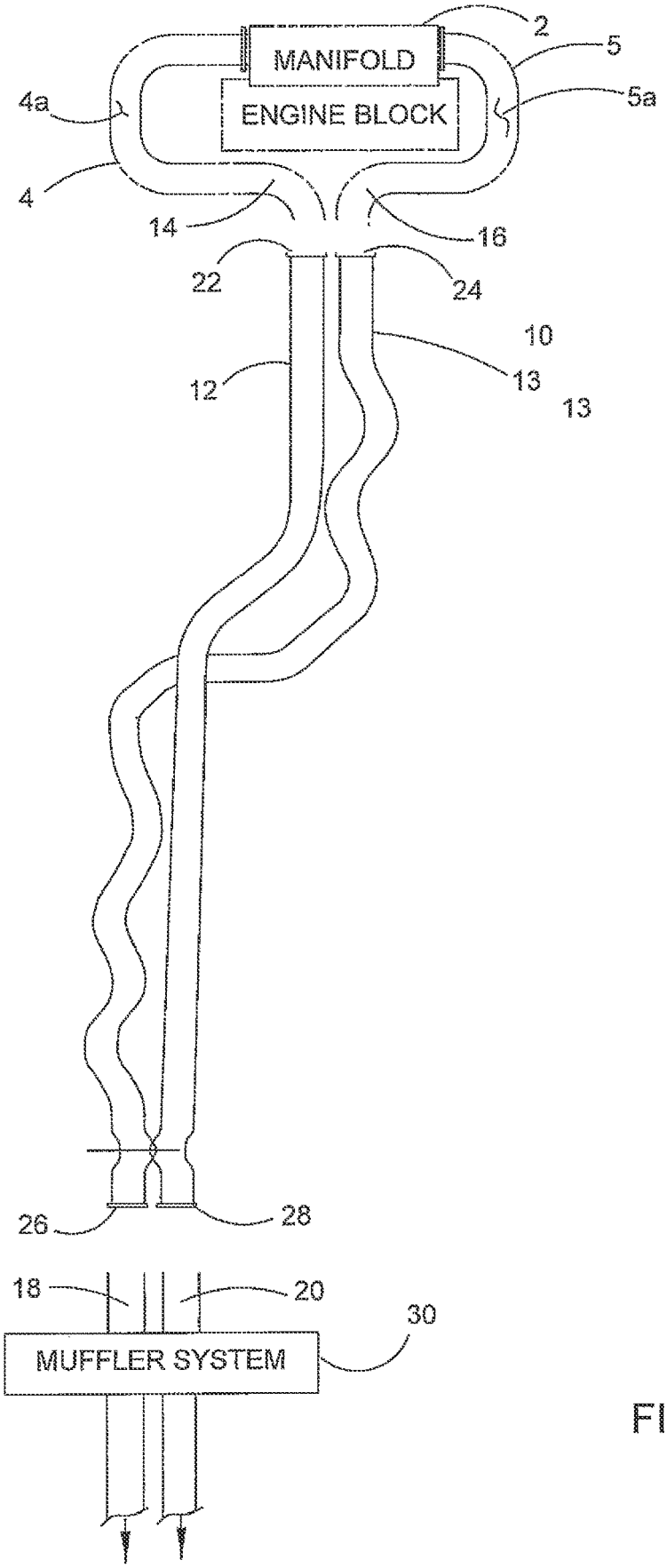
FIGS. 1A and 1B diagrammatically illustrate the mid-pipes as part of the tailpipe system and FIG. 1A schematically illustrates the internal combustion engine, its manifold and, at the terminal downstream or rear end, the muffler system and FIG. 1B schematically illustrates the pipe cross-over.

The present invention relates to a sinuous balanced tailpipe system and method. Similar numerals designate similar items in the drawings. While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 1B:
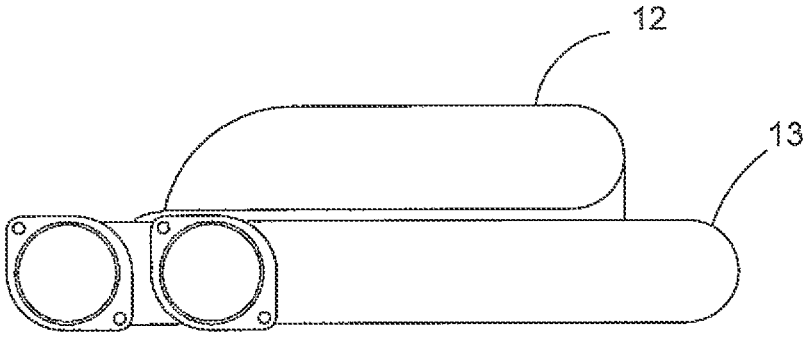
Figure 2:
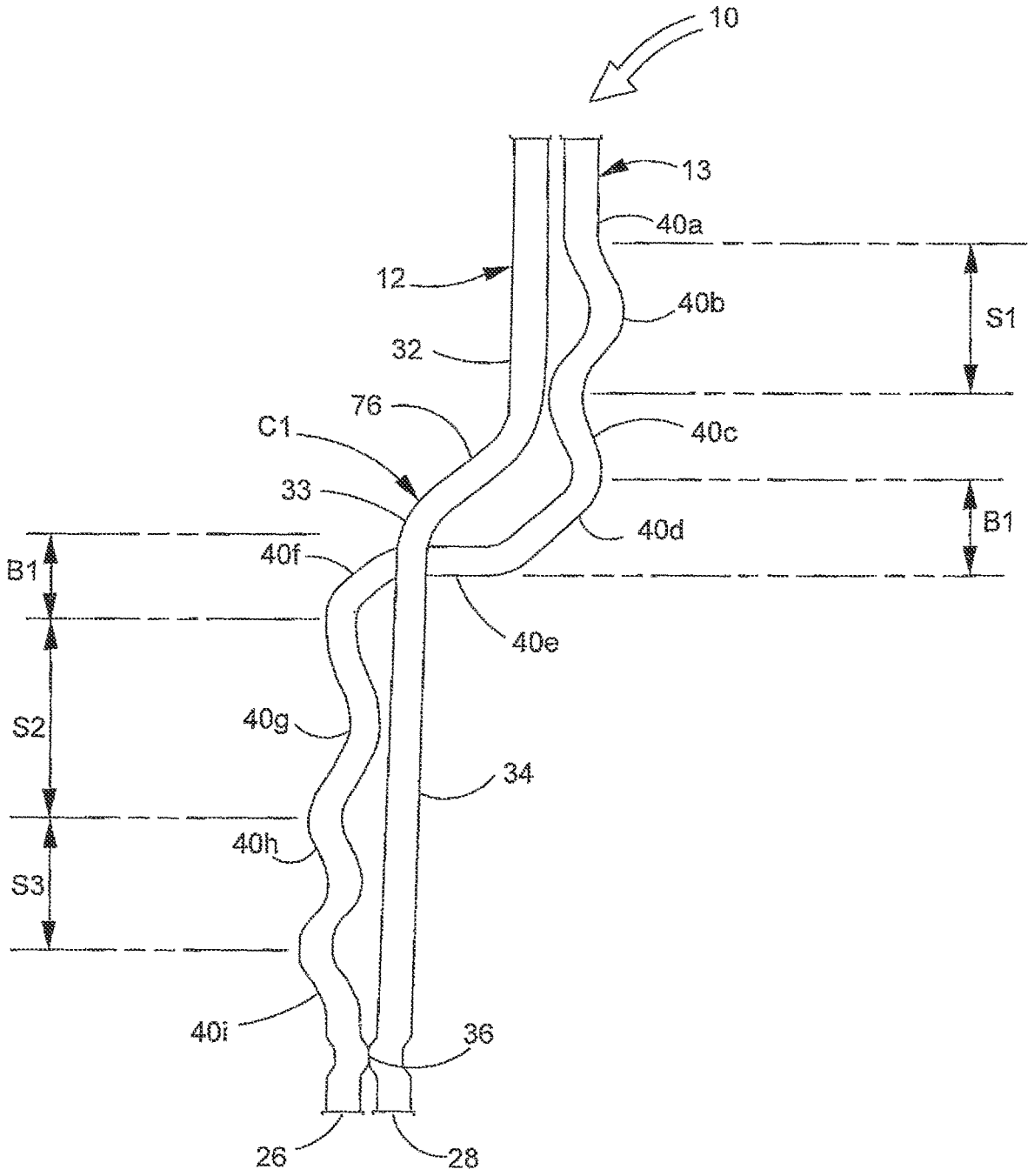
FIG. 2 diagrammatically illustrates the mid-pipes and schematically illustrates three sinusoidal segments S1, S2, S3 and several curvaceous segment B1, B2, and a shallow curvaceous segment C1.
Figure 3:
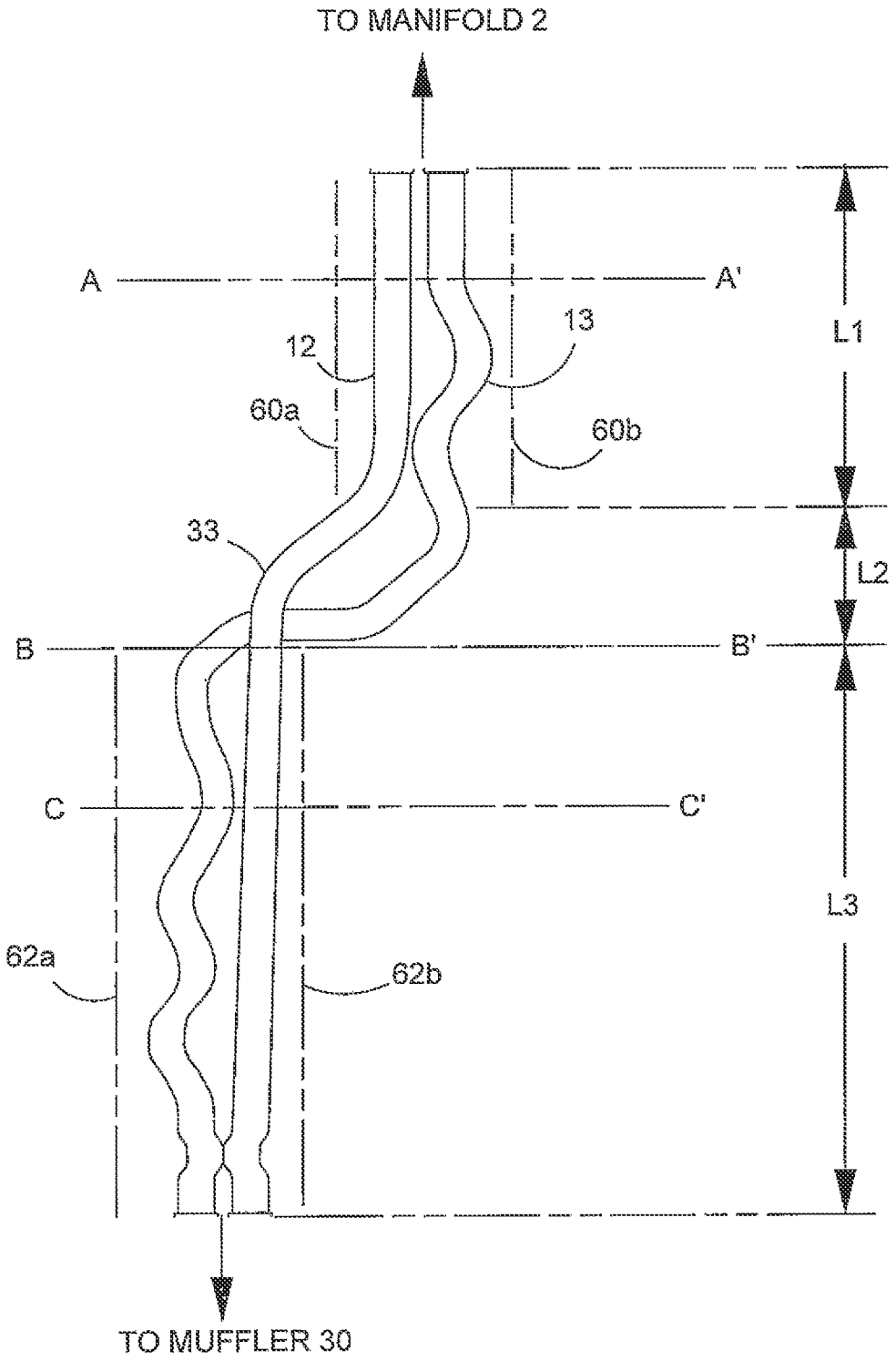

FIG. 1A diagrammatically illustrates the mid-pipes as part of the tailpipe system and schematically illustrates the internal combustion engine, its manifold and, at the terminal downstream or rear end, the muffler system and FIG. 2 schematically illustrates three sinusoidal segments S1, S2, S3 and several curvaceous segment B1, B2, and a shallow curvaceous segment C1. FIGS. 1A, 1B, and 2 are discussed concurrently herein. Mid-pipe system 10 consistes of two pipes, one substantially straight mid-pipe 12 and sinusoidal mid-pipe 13. These mid-pipes are part of a tailpipe system that runs from the exhaust output of the manifold 14, 16 to the inputs 18, 20 of the muffler system at the rear end of the vehicle. The first and second manifold output ports 14, 16 are adjacent each other at a front end of the predefined undercarriage passageway (FIG. 3) and the first and second muffler input ports 18, 20 are adjacent each other at a rear end of the undercarriage passageway.

Each mid-pipe has, at its upstream or front terminal end, a flange 22, 24 and at its downstream or rear terminal end, a flange or fitting 26, 28. Upstream flanges 22, 24 are conventionally fixed (with bolts, seals, or welding) to the manifold outputs 14, 16. The internal combustion engine 1 has a manifold 2. The first manifold pipe 4 has a longer exhaust gas flow path 4*a* compared with the bilateral manifold exhaust pipe 5 which has a shorted manifold exhaust path 5*a*. These pipes 4, 5 have a differential exhaust pipe length, sometimes called a bilateral differential length, which when fluidly coupled to the manufacturer-supplied generally straight mid-pipes, causes noxious noises during the operation of the vehicle. The inventive system and method corrects for the bilateral differential in the manifold portion of the tailpipe system by adding exhaust gas pathway to one of the two mid-pipes.

At the rear end of the vehicle, the terminal ends 26, 28 of the mid-pipes 13, 12 (note the translation of mid-pipe 13 from the passenger side position to the driver's side position by the cross-over, see FIG. 1B) are conventionally fixed (with bolts, seals, or welding) to the input ports 18, 20 of muffler system. FIG. 1A shows that exhaust gas leaves the muffler by the two arrows.

With respect to the substantially straight mid-pipe 12 and in connection with FIG. 2, pipe 12 has upstream straight pipe segment 32, leading to a shallow curve C1, an overpass at pipe segment 33 and leading to a downstream straight pipe segment 34. Adjacent its terminal end 28, pipe 13 has an exhaust gas crossover mixing joint 36 with mid-pipe 12. The most terminal region of pipe 12 fits and mounts onto the muffler input 20 at downstream end 28 of pipe 12. The term "shallow curvaceous segment" refers to pipe curves substantially no more than 45-65 degrees. In the preferred embodiment, curve C1 is about 45 degrees with respect to the longitudinal centerline of the straight pipe segments 32, 34. More importantly, shallow curvaceous segments are highly distinguishable from the 360 degree sinusoidal segments discussed below. Straight pipe 12 is connected to the longer manifold exhaust pipe 4 (FIG. 1A). It should be noted that the left and right side positions of pipes 12, 13 can be exchanged dependent upon which manifold exhaust pipe is longer. However, the longer manifold exhaust pipe is fluidly connected to the straight mid-pipe 12 because the sinuous mid-pipe 13 is configured to enlarge the exhaust gas flow path such that the sinuous pipe flow path substantially equals, matches or balances with the bilateral differential length of two manifold exhaust pipes.

Sinuous mid-pipe 13 has a variety of curves, some shallow curvaceous curves, some curves forming nearly 90 degree pipe turns and flow passages and at least two full sinusoidal segments S1, S2, and in the preferred embodiment, a third sinusoidal segment S3. The resulting combination of shallow curvaceous curves, formidable curves and sinusoidal curves (the latter being full 360 degree curve). Pipe 13 has an upstream straight segment 40*a* with a forward terminal end 24 (FIG. 1A) fixed to the output port 16 of the shorter manifold exhaust pipe 5. Downstream segment 40*a* is sinusoidal curved segment 40*b*. The sinusoidal curve spans distance S1 and it is known that the fluid path way in segment 40*b* I longer than longitudinal distance S1. The next following segment 40*c* is a shallow curvaceous curved segment.

Curved pipe segment 40*d* defines bend B1 in pipe 13. Pipe 13 then defines an underpass with segment 40*e*. This underpass is needed due to the lateral passageway formed by the undercarriage of the vehicle as described later in connection with FIG. 3 and FIG. 4B. Segment 40*e* is fairly straight but is laterally disposed such that the further downstream pipe segments of pipe 13 are translated to the driver's side of the vehicle. The straight mid-pipe 12 has an angular cross-over segment 76 (FIG. 3) and the sinuous mid-pipe 13 has either a curvaceous underpass or an overpass segment at point 33 (FIG. 3) adjacent the angular cross-over 76 due to a lateral passage L2 in the predefined undercarriage passageway shown in FIG. 3.

Pipe 13 has curved segment 40*f* forming bend B2. This leads to two (2) sinusoidal segments S2, S3 formed by pipe segments 40*g*, 40*h*. the crossover mix joint 40*i* is downstream sinusoidal segment 40*h*. Terminal end 26 completes the run of mid-pipe 13.

In order to design the sinuous balanced tailpipe system, one can estimate the length of the differential between the manifold exhaust pipes (the differential being the flow path difference between path 4*a* and path 5*a* in FIG. 1A). One needs to be mindful of the form fitted nature of the mid-pipes in the undercarriage space. The lateral span of the undercarriage space (see FIG. 3) must be taken into account in determining the height of each sinusoidal 360 degree curve segment. Also, the total length of the undercarriage space (FIG. 3, L1+L2+L3) is another limiting factor. The sinusoidal length added to the sinuous midsectional pipe to compensate for foreshortened exhaust manifold pipes can be estimated by calculating the arc length of a curve. See Interactive Mathematics, sec.11 at www.intmath.com/applications-integration/11-arc-length-curve.php, last visited Feb. 26, 2020. More accurate calculations are discussed at "Mathematics: What is the length of a sine wave from 0 to 2π" at https://math.stackexchange. com/questions/45089/what-is-the-length-of-a-sine-wave-from-0-to-2-pi/2471308#2471308, last visited Feb. 26, 2020. Using the lateral undercarriage data, less room for thermal expansion and any undercarriage brackets, the remaining useful lateral undercarriage space is used to limit the height or y axis span of the sinusoidal curve. The x axis span of the sinusoidal curve is limited by the longitudinal space of all segments joined together. As for shallow curves, portions of the sinusoidal curve algorithm can be used to estimate the length of the added-on exhaust flow path to pipe 13.

FIGS. 3 and 4A, 4B and 4C diagrammatically illustrate the mid-pipes (FIG. 3) and schematically illustrates the cross-sectional shape of the tailpipe passage defined by the undercarriage of the vehicle. The total longitudinal span of the undercarriage spatial cavity is L1+L2+L3, not accounting for the upstream end of pipes 12, 13 to attach to the downstream manifold exhaust pipe segments, terminating in ports 14, 16 in FIG. 1A. The undercarriage space has a forward straight segment with a length L1 between imaginary spatial lines 60*a*, 60*b*. FIG. 4A shows the height profile of space 60*a*, 60*b*, L1 with respect to the lowest generally planar surface 61 at the cross-sectional line A-A'. In the working embodiment, the undercarriage space has a lateral transitional area bounded by L2. Cross-sectional line B-B' and FIG. 4B shows the laterally wide undercarriage space for the transitional area of pipes 12, 13. As stated earlier, the sinusoidal pipe 13 passes beneath straight pipe 12 in transition area L2 at 33, see FIG. 1B. At undercarriage spatial segment L3, the tailpipe space narrows to the profile shown in FIG. 4C which lateral span is similar to the lateral span of the undercarriage space in segment L1. Compare spatial profile in FIG. 4A to spatial profile in FIG. 4C. Also, the undercarriage space in run L3 is substantially straight and is bounded by imaginary spatial lines 62*a*, 62*b*.

Figure 5A:
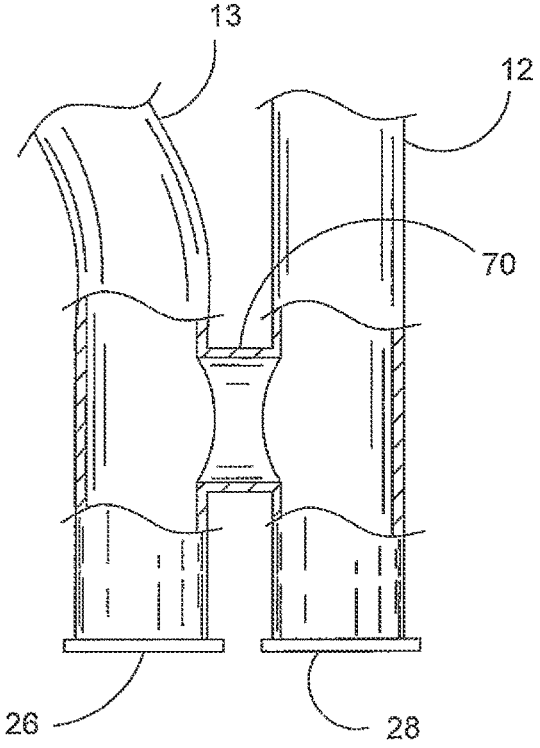
FIGS. 5A and 5B diagrammatically illustrate two gas cross-over mixer segments for the mid-pipes adjacently the muffler input ports near the downstream terminal ends of the mid-pipes.
Figure 5B:
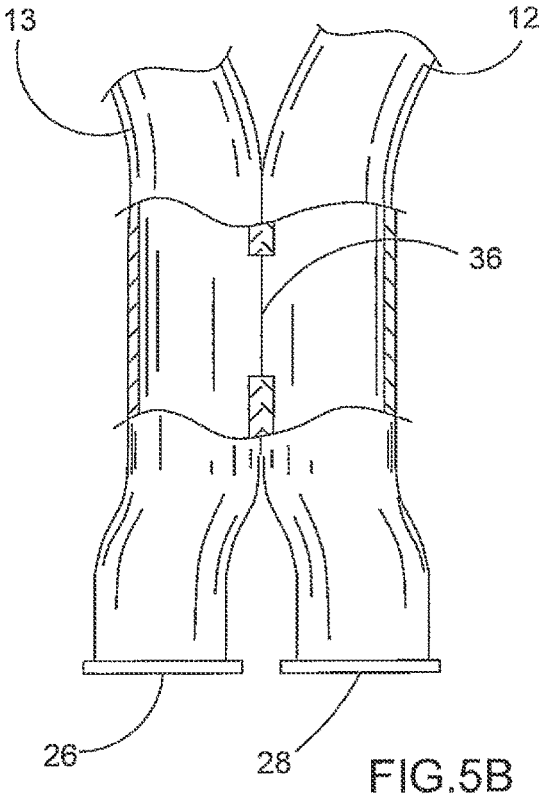

FIGS. 5A and 5B diagrammatically illustrate two gas cross-over mixer segments for the mid-pipes adjacently the muffler input ports near the downstream terminal ends of the mid-pipes. In FIG. 5A, the cross-over mixer is a short lateral pipe segment 70 joining sinuous pipe 13 to straight pipe 12. The cross-over mixer pipe 70 is adjacent the terminal ends 26, 28 of the mid-pipes which, in turn, are fixed to the muffler inputs. In FIG. 5B, a cross-over joints 36 is formed to facilitate the mixing of exhaust gas.

As noted in the Figures, the size of pipes 12, 13 (generally the cross-sectional sizes) are identical as is the inside configurations of these pipes. In additional, the cross-over mixers in FIGS. 5A and 5B have substantially the same fluid spatial dimensions as the adjacent portions of exhaust pipes 12, 13.

In operation, the method balances and equalizes exhaust gas flow paths between the differential pipe paths in the manifold output pipes 4, 5. The bilateral manifold exhaust pipes have a differential manifold gas flow path length (4*a* less 5*a*). Pipe 12 defines a substantially straight exhaust gas flow path (FIG. 3) having a predetermined exhaust gas flow path length (L1+L2+L3, plus accounting for shallow curvaceous segment 76, C1, among other curvaceous segments). Pipe 13 defines a sinuous gas flow path with at least two sinusoidal segments (S1, S2) from the manifold output 16 to the muffler input 18. In the preferred embodiment, the sinuous gas flow path has three sinusoidal segments (S1, S2, S3) from the manifold to the muffler. In a minimum construction of the invention, the sinuous gas flow path is substantially equal to the predetermined flow path length of the straight pipe 12 (L1+L2+L3) plus the differential manifold path length (the difference between paths 4*a* and 5*a*) and this longer sinuous gas flow path in the preferred embodiment consists of the three sinusoidal segments (S1, S2, S3). The sinuous gas flow path accepts exhaust gas from the shorter manifold pipe 5. Additional curvaceous segments, some shallow curves (40*c*) and some major curves (B1+B2) also add to the sinuous gas flow path of pipe 13. Hence, the sinuous gas flow path of pipe 13 has at least two sinusoidal segments and can optionally include one or more shallow curvaceous segment. The sinuous path length also accounts for the straight pipe 12 with shallow curvaceous segment C1 therein. The sinuous gas flow path in pipe 13 includes compensating curvaceous segment(s) such that the sinuous gas flow path substantially equals the predetermined flow path length through straight pipe 12 (including segment C1) and the differential manifold pipe length. Compensating curvaceous segments in the sinuous gas flow path include curves 40*d*, 40*f*, 40*i*. The straight exhaust gas flow path in pipe 12 and the sinuous gas flow path in pipe 13 are independent gas flows until being mixed together at coupler or joint 36, 70 adjacently upstream the muffler 30.

The sinuous balanced tailpipe system consists of two mid-pipes which are sold in the after-market. The system 10 (FIG. 1A) is sold separately from the vehicle itself. However, the manufacturer may decide to equip its vehicles with the sinuous balanced tailpipe system described herein. The system is used in combination with an internal combustion engine 1 having first and second manifold exhaust pipes with a differential length therebetween, the first manifold pipe being substantially longer 4 than the second manifold pipe 5. The straight mid-pipe has a predetermined fluid path length (L1+L2+L3 plus gentle shallow curve 76, C1). The major contribution to the length of the sinuous gas flow path defined by pipe 13 is the three sinusoidal segments (S1, S2, S3). However, additional shallow curves (40*c*) and some major curves (B1+B2) also add to the sinuous gas flow path of pipe 13. In large part, the sinuous flow path is substantially equal to the predetermined flow path length of the straight pipe 12 (L1+L2+L3) and the differential manifold flow path length (flow path 4*a* minus 5*a*) and this longer sinuous flow path consists of at least two 360 degree sinusoidal curves and, in one preferred embodiment, three sinusoidal segments (S1, S2, S3). Additional curvaceous segments, some shallow curves (40*c*) and some major curves (B1+B2) also add to the sinuous gas flow path of pipe 13.

The problem solved by the present invention involved an inline six cylinder combustion engine. Oftentimes these engines have an evenly spaced exhaust pulse which results in a more smooth and full sounding noise (timbre) from the exhaust system during operation of the vehicle. However, the twin turbo setup of the BMW S55 engine, while producing additional power, creates a sound which sounds more like two, independent inline three cylinder engine competing for noise than the throaty sound the BMW driver would expect.

The variance between the lengths of the front and rear manifold down-pipes of almost a foot and a half creates unevenly spaced pulses of exhaust gas emanating from the engine so that when the exhaust gas merges, in any form of crossover system whether stock, x-pipes, double x-pipes, single mid-pipe or rear-section solutions, these noxious sounding gas pulses emerge from the exhaust system. Since the sound waves are moving at the same rate when they exit the system, these crossover sections are simply creating a higher pitched sound resulting in the annoying sound that some consumers have referred to as a weed eater sound in these BMW models. Current prior art systems allow the exhaust gas banks to merge unequally combining pulsed sounds. Research and testing determined that equalizing the length of the exhaust pipes before mixing or merging the exhaust gases from each independent tailpipe segment was a solution to this sound problem.

In one preferred embodiment, the inventive system is a single mid-pipe system (the system comprising two mid-pipes) for the BMW F-series and M series cars. Requiring a brand new rear exhaust system for these high-end vehicles is not a typical solution. The inventive system adds length to one mid-pipe section and creates a new crossover section to generate a harmonious exhaust note or timbre sound for the user. The inventive system uses a crossover with sinusoidal pipes to correct the downpipe length variance before mixing the sounds thereby creating the expected 6 cylinder sports car exhaust notes or timbre.

The current embodiment of the invention is a mid-pipe system specifically designed to create substantially equal length exhaust pipes adjusting for the difference between the front and rear banks of the BMW F80 M3 and F82 M4 down pipes before mixing the exhaust gas in an X-pipe (or an H-pipe) and creating an exhaust note or timbre sound different from the normal "S55 sound". Engineered for an exact form fit beneath the undercarriage of both BMW models F80 M3 and F82 M4, the difference in sound and timber with this mid-pipe system is noticeable the first time the vehicle runs at open throttle.

This inventive technique of using sinusoidal curves created in one of the two mid-pipes (both forming a portion of the tailpipe system) such that the sinusoidal mid-pipe has a substantially equal length compared to the relatively straight, companion mid-pipe, can be deployed in other vehicles to achieve an acceptable exhaust sound or timbre for the entire exhaust system. Stated otherwise, the invention is not limited to the BMW models described above. Both the sinusoidal curve mid-pipe and the relatively straight companion mid-pipe should be designed to fit beneath the undercarriage of the vehicle as a form fitted, dual pipe system.

The 12-16 inch differential created by the different lengths of the exhaust manifold pipes in these BMW models is accounted for by a series of sinusoidal curves defined by one midsection tailpipe whereas the other midsection tailpipe is effectively a substantially straight run or a straight run with a slightly bent central region. To achieve this form-fitted, sinuous balanced tailpipe system (the form and shapes of the midsectional pipes fitted into the form defined beneath the undercarriage of the vehicle), at least two sinusoidal curves are formed in one of the midsection tailpipes, whereas the other midsection tailpipe is effectively a straight run or a slightly bent midsection tailpipe dependent upon the tailpipe passage formed beneath the undercarriage of the automobile. In the preferred embodiment, form fitted beneath the aforementioned BMW undercarriage, three two sinusoidal curves are formed in one of the midsection tailpipes to account for and create an exhaust gas path substantially equivalent to the substantially straight run of the other midsectional pipe.

In the illustrated embodiment herein, the right side 3-wave sinuous midsectional tailpipe 13 has a run or a length that adds about 14 inches to the entire tailpipe thereby compensating for the differential length in the BMW manifold exhaust pipes (the manifold exhaust pipes directly coupled to the manifold on the engine). Due to the underpass segment at point 33 (FIG. 3) of the two midsectional pipes, the right side sinuous midsection tailpipe 13 translates to a translated left side midsection pipe near the muffler box 30.

In the illustrated embodiment which accounts for the 14 inch BMW differential in the manifold exhaust pipes, a first sinusoidal curve S1 proximal the manifold output is created in the right side pipe as shown in FIG. 2. The sinusoidal curve S1 adds length to the right side midsection pipe 13. Thereafter further downstream this midsection pipe, the right side pipe has a 45° bend B1 and, as shown in FIG. 2, a lateral, underpass segment translating this right side pipe 13 into a translated left side pipe segment 13.

What is claimed is:

1. In combination with an internal combustion engine having first and second manifold exhaust pipes with a differential length therebetween, the first manifold pipe being substantially longer than the second manifold pipe, each having respective first and second manifold output ports, and a downstream, terminal end muffler system with first and second muffler input ports, a sinuous balanced mid-pipe exhaust system disposed intermediate the first and second manifold output ports and the first and second muffler input ports comprising:

a first mid-pipe having a corresponding first upstream port adapted to be fluidly connected to the first manifold output port and having a corresponding first downstream port adapted to be fluidly connected to the first muffler input port, the first mid-pipe having a predetermined fluid path length; and a second mid-pipe as a sinuous mid-pipe having a corresponding second upstream port adapted to be fluidly connected to the second manifold output port and having a corresponding second downstream port adapted to be fluidly connected to the second muffler input port, the sinuous mid-pipe having two or more substantially sinusoidal curved segments such that a sinuous fluid path through the sinuous mid-pipe substantially equals the predetermined fluid path length and the differential length;

wherein the first and second manifold output ports are adjacent each other at a front end of a predefined undercarriage passageway and wherein the first and second muffler input ports are adjacent each other at a rear end of the undercarriage passageway and the first mid-pipe and the sinuous mid-pipe are form-fitted and adapted to be disposed in the undercarriage passageway.

2. The combination as claimed in claim 1 wherein each sinusoidal curved segment forms a 360 degree sine curve in the sinuous mid-pipe.

3. The combination as claimed in claim 1 wherein the first mid-pipe has an angular cross-over segment and the sinuous mid-pipe has either a curvaceous underpass or an overpass segment adjacent the angular cross-over due to a lateral passage in the predefined undercarriage passageway.

4. The combination as claimed in claim 1 including an exhaust gas crossover at downstream regions of the first mid-pipe and the sinuous mid-pipe fluidly mixing exhaust gas adjacently upstream the first and second muffler input ports.

5. The combination as claimed in claim 4 wherein the first mid-pipe, the sinuous mid-pipe and the gas crossover have substantially similar cross-sectional dimensions.

6. The combination as claimed in claim 3 including an exhaust gas crossover at downstream regions of the first mid-pipe and the sinuous mid-pipe fluidly mixing exhaust gas adjacently upstream of the muffler, and wherein the first mid-pipe, the sinuous mid-pipe and the gas crossover have substantially similar cross-sectional dimensions.

7. A sinuous balanced mid-pipe exhaust system disposed intermediate a bilateral manifold and a downstream muffler, the bilateral manifold having first and second manifold pipes and respective manifold output ports which are adjacent each other and the first and second manifold pipes having a differential manifold pipe length, and the muffler having first and second muffler input ports, comprising:

a first mid-pipe adapted to be mounted at a corresponding upstream end to the first manifold output port and at a corresponding downstream end to the first muffler input port, the first mid-pipe having a predetermined exhaust gas flow path length from the manifold to the muffler; and a sinuous mid-pipe adapted to be mounted at a respective upstream end to the second manifold output port and at a respective downstream end to the second muffler input port, the sinuous mid-pipe having at least two sinusoidal curved segments such that a sinuous gas flow path therethrough substantially equals the predetermined flow path length and the differential pipe length;

wherein the first and second manifold output ports are adjacent each other at a front end of a predefined undercarriage passageway and wherein the first and second muffler input ports are adjacent each other at a rear end of the undercarriage passageway and the straight mid-pipe and the sinuous mid-pipe are form-fitted and adapted to be disposed in the undercarriage passageway.

8. The sinuous balanced mid-pipe exhaust system as claimed in claim 7 including a crossover gas mixer fluidly connected to the sinuous mid-pipe and the first mid-pipe at adjacently upstream the muffler input ports, the crossover gas mixer having a gas flow passage substantially equivalent to gas flow passages in the sinuous mid-pipe and first mid-pipe.

9. The sinuous balanced mid-pipe exhaust system as claimed in claim 7 wherein the first mid-pipe has a curvaceous segment and the sinuous gas flow path defined by the sinuous mid-pipe includes a compensating curvaceous segment such that the sinuous gas flow path substantially equals the predetermined flow path length and the differential pipe length.

* * * * *